US009831557B2

(12) United States Patent
Park et al.

(10) Patent No.: US 9,831,557 B2
(45) Date of Patent: Nov. 28, 2017

(54) BROADBAND CIRCULARLY POLARIZED ANTENNA USING METASURFACE

(71) Applicant: AJOU UNIVERSITY INDUSTRY-ACADEMIC COOPERATION FOUNDATION, Suwon-si, Gyeonggi-do (KR)

(72) Inventors: Ikmo Park, Yongin-si (KR); Son Xuat Ta, Suwon-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 52 days.

(21) Appl. No.: 15/171,633

(22) Filed: Jun. 2, 2016

(65) Prior Publication Data

US 2017/0117633 A1 Apr. 27, 2017

(30) Foreign Application Priority Data

Oct. 22, 2015 (KR) ..... 10-2015-0147351

(51) Int. Cl.
*H01Q 9/04* (2006.01)
*H01Q 1/50* (2006.01)
*H01Q 1/48* (2006.01)

(52) U.S. Cl.
CPC ..... *H01Q 9/0407* (2013.01); *H01Q 1/48* (2013.01); *H01Q 1/50* (2013.01)

(58) Field of Classification Search
CPC ..... H01Q 9/0407; H01Q 1/48
(Continued)

(56) References Cited

U.S. PATENT DOCUMENTS 6,211,824 B1 * 4/2001 Holden ..... H01Q 1/523 343/700 MS
2003/0063031 A1 * 4/2003 Wong ..... H01Q 1/38 343/700 MS (Continued)

FOREIGN PATENT DOCUMENTS

KR 10-2013-0091603 A 8/2013

OTHER PUBLICATIONS

SonXuat Ta et al., "A Circularly Polarized Patch Antenna Loaded with Metamaterial", Sep. 7-12, 2015, 9th International Congress on Advanced Electromagnetic Materials in Microwaves and Optics—Metamaterials 2015, pp. 466-468.

(Continued)

*Primary Examiner* — Dameon E Levi
*Assistant Examiner* — Hasan Islam
(74) *Attorney, Agent, or Firm* — Stein IP, LLC

(57) ABSTRACT

Provided is a broadband circularly polarized antenna using a metasurface. The antenna includes a lower substrate, an upper substrate stacked on the lower substrate, a radiator, which is located between the lower substrate and the upper substrate, has a rectangular patch shape in which two triangular removed parts are formed by removing opposite corners in a triangular shape, extends so as to have a predetermined width and length from one end of a hypotenuse of one triangular removed part of the triangular removed parts, and includes an extended strip having a feed hole formed therein, and the metasurface formed on an upper surface of the upper substrate and including a plurality of unit cells. The antenna has improved performance, such as a low profile, a broadband circular polarization characteristic, a high gain characteristic, and the like.

11 Claims, 10 Drawing Sheets

(58) Field of Classification Search
USPC ..... 343/700 MS, 846
See application file for complete search history.

(56) References Cited

U.S. PATENT DOCUMENTS

| | | | | |
|---|---|---|---|---|
| 2009/0153404 | A1* | 6/2009 | Ryou | H01Q 9/0407 343/700 MS |
| 2016/0118720 | A1* | 4/2016 | Kim | H01Q 1/3275 343/700 MS |

OTHER PUBLICATIONS

Korean Office Action dated Jul. 20, 2016, issued to Korean Application No. 10-2015-0147351.

* cited by examiner

BROADBAND CIRCULARLY POLARIZED ANTENNA USING METASURFACE

CROSS-REFERENCE TO RELATED APPLICATION

This application claims priority to and the benefit of Korean Patent Application No. 10-2015-0147351, filed on Oct. 22, 2015, the disclosure of which is incorporated herein by reference in its entirety.

BACKGROUND

1. Field of the Invention

The present invention relates to an antenna, and more particularly, to a broadband circularly polarized antenna using a radiator disposed between a metasurface and a ground plane.

2. Discussion of Related Art

Generally, antennas, which are conducting wires installed in the air in order to efficiently radiate electric waves to spaces or efficiently maintain electromotive force by the electric waves, are apparatuses which transmit and receive electromagnetic waves to and from a space for transmission and reception in order to achieve communication purposes in wireless communication.

Currently, a microstrip patch antenna of the antennas is being widely used in wireless communication systems due to its advantages such as a small size, high efficiency, broadband, multi-band, a specific radiation pattern, ease of manufacture and integration, low cost and the like.

The antenna requires a circular polarization characteristic rather than a linear polarization in many applications. This is because of advantages such as a strong circular polarization in a communication environment concerning polarization distortion, which is caused by radio interference in space and Faraday rotation, and a mitigated multipath fading compared to the linear polarization.

In order to achieve the circular polarization characteristic, a single feed circular polarization microstrip patch antenna has entered the spotlight. However, there is a disadvantage in that a bandwidth is small, less than 5%, in impedance matching and an axial ratio.

Conventionally, in order to increase the bandwidth of the single feed circular polarization microstrip patch antenna, attempts using a thick substrate, an L-shaped strip feed, loaded shorting pins, a stacked patch structure, and the like have been made. However, in most of the structures, there was a problem that an antenna height requires $0.1\lambda_o$ or a greater level.

Recently, in order to improve the performance of the antenna, such as size reduction, bandwidth expansion, and the like, research on a circularly polarized patch antenna using a metamaterial is being actively conducted. However, a circularly polarized antenna using a metamaterial while simultaneously satisfying a low antenna height and a bandwidth at an appropriate level or more has not yet been developed.

DOCUMENT OF RELATED ART

Patent Document

Korean Laid-open Patent Application No. 2013-0091603 "DUAL-BAND CIRCULAR POLARIZED PATCH ANTENNA USING METAMATERIAL" (Published on Aug. 19, 2013)

SUMMARY OF THE INVENTION

The present invention is directed to a broadband circularly polarized antenna having improved performance, such as a low profile, a broadband circular polarization characteristic, a high gain characteristic, and the like through a structure in which a radiator of the antenna is sandwiched between a ground plane and a metasurface.

According to an aspect of the present invention, there is provided a broadband circularly polarized antenna using a metasurface including a lower substrate, an upper substrate stacked on the lower substrate, a radiator, which is located between the lower substrate and the upper substrate, has a rectangular patch shape in which two triangular removed parts are formed by removing opposite corners in a triangular shape, and includes an extended strip which extends so as to have a predetermined width and length from one end of a hypotenuse of one triangular removed part of the triangular removed parts and has a feed hole formed therein, and the metasurface formed on an upper surface of the upper substrate and including a plurality of unit cells.

The extended strip may be formed to protrude from one side of the radiator in a vertical direction.

The two triangular removed parts may be symmetrical with respect to a center of the radiator.

The antenna may further include a feed which is connected to the feed hole of the radiator and transfers a signal.

A ground plane may be formed on a lower surface of the lower substrate.

An inner part of the feed may be electrically connected to the feed hole of the radiator by passing through the lower substrate, and an outer part of the feed may be electrically connected to the ground plane.

The unit cells may each be configured as metal plates, and may be formed in a lattice structure in which the metal plates are arranged with a gap of a predetermined size to have periodicity.

A surface wave propagated along the metasurface may be excited, and the metasurface may additionally generate at least one of a resonance frequency in a reflection coefficient profile and a minimum axial ratio point in an axial ratio profile.

The lattice structure may be formed so that the unit cells are arranged in a 4×4 therein.

The minimum axial ratio point generated by the surface wave may tend to move to a low-frequency region as the number of the unit cells is increased.

The radiator may be formed on an upper surface of the lower substrate.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
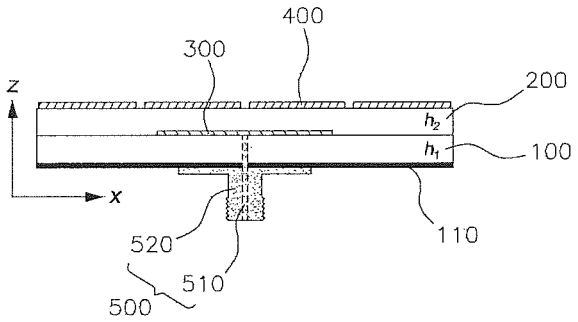
FIG. 1 is a cross-sectional view illustrating a broadband circularly polarized antenna using a metasurface according to an embodiment of the present invention.

Hereinafter, exemplary embodiments of the invention will be described in detail with reference to the accompanying drawings so that those skilled in the art may easily perform the invention. In this specification, when reference numerals are assigned to components of each drawing, it should be noted that the same numerals are assigned to the same components whenever possible when the same components are illustrated in different drawings. In descriptions of the invention, when detailed descriptions of related well-known technology are deemed to unnecessarily obscure the gist of the invention, they will be omitted.

Hereinafter, embodiments will be described more fully with reference to the accompanying drawings, in which exemplary embodiments of embodiments are shown.

Figure 2:
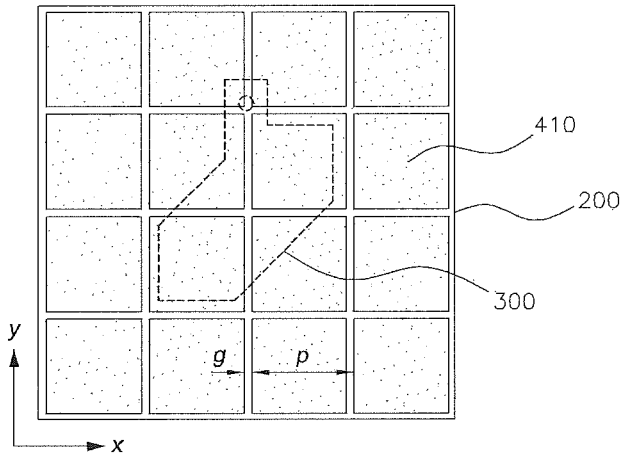
FIG. 2 is a plan view illustrating a broadband circularly polarized antenna using a metasurface according to an embodiment of the present invention.
Figure 3:
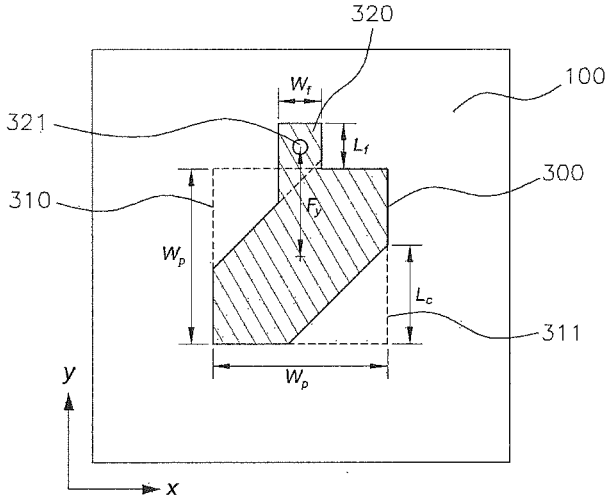
FIG. 3 is a plan view illustrating a radiation patch of a broadband circularly polarized antenna using a metasurface according to an embodiment of the present invention.

FIG. 1 is a cross-sectional view illustrating a broadband circularly polarized antenna using a metasurface according to an embodiment of the present invention, FIG. 2 is a plan view illustrating a broadband circularly polarized antenna using a metasurface according to an embodiment of the present invention, and FIG. 3 is a plan view illustrating a radiation patch of a broadband circularly polarized antenna using a metasurface according to an embodiment of the present invention.

Referring to FIGS. 1 to 3, a broadband circularly polarized antenna using a metasurface according to an embodiment of the present invention may include a lower substrate 100, an upper substrate 200, a radiator 300, a metasurface 400, and the like.

Each of the upper substrate 200 and the lower substrate 100 may be formed using a dielectric substrate formed of a dielectric material, and preferably may be formed of a material having a high permittivity.

A material of the dielectric substrate may include all dielectric substrate materials used conventionally in the art such as epoxy, Duroid, Teflon, Bakelite, a high-resistance silicon, glass, alumina, a low temperature co-fired ceramic (LTCC), air foam, and the like.

The upper substrate 200 and the lower substrate 100, which are divided by relative positions of each other, may be formed of the same material or different materials, and preferably may be formed to have the same shape and area of a plane.

In the drawings, each of the upper substrate 200 and the lower substrate 100 has a horizontal length, a vertical length, and a height, and has a square pillar shape in which the horizontal length and the vertical length are greater than the height and the horizontal length and the vertical length are the same. In this case, the height of the upper substrate 200 is represented as $h_2$ and the height of the lower substrate 100 is represented as $h_1$.

However, a shape and size of the substrate is not limited thereto, the substrate may be formed in various shapes such as a circular cylinder shape, a rectangular pillar shape, a polygonal pillar shape, and the like.

The upper substrate 200 may be preferably stacked on an upper surface of the lower substrate 100 without an air gap to have a low antenna height and to be easily manufactured.

The radiator 300 may be used as a microstrip patch type driven patch, may be disposed between the upper substrate 200 and the lower substrate 100, and may be preferably formed on the upper surface of the lower substrate 100.

A basic shape of the radiator 300 is a rectangular shape, and is preferably a square shape. In the drawings, horizontal and vertical lengths of the radiator 300 are each represented as $W_p$, and the center of the radiator 300 may be determined based on the basic shape of the radiator 300.

The rectangular-shaped radiator 300 has four vertexes, and has two pairs of opposite vertexes. The radiator 300 may have a rectangular patch shape in which two triangular removed parts 310 and 311 are formed by removing outer parts of two opposite vertexes in a triangular shape or by removing opposite corners in a triangular shape.

The triangular removed parts 310 and 311 may have various shapes, for example, the pair of opposite vertexes may be formed in a symmetrical structure, and lengths of sides adjacent to a right angle may be the same. Preferably, the two triangular removed parts 310 and 311 are symmetrically formed with respect to the center of the radiator 300, and the length of each of the sides adjacent to the right angle is represented as $L_c$ in the drawings.

The radiator 300 may extend from one end of the hypotenuse of the triangular removed part 310 of the triangular removed parts 310 and 311 to have a predetermined width and length, and may include an extended strip 320 having a feed hole 321 formed therein.

The extended strip 320 may improve impedance matching, and is preferably formed to protrude from one side of the radiator 300 in a vertical direction. In the drawings, a length of the extended strip 320 is represented as $L_f$, a width thereof is represented as $W_f$, and a distance from the center of the radiator 300 to the feed hole 321 is represented as $F_y$.

The broadband circularly polarized antenna using the metasurface according to the embodiment of the present invention may further include a feeder 500, which is connected to the feed hole 321 of the radiator 300 to transfer a signal, and a ground plane 110 formed on a lower surface of the lower substrate 100.

An inner part 510 of the feeder 500 may be electrically connected to the feed hole 321 of the radiator 300 by passing through the lower substrate 100, and an outer part 520 of the feeder 500 may be electrically connected to the ground plane 110.

The metasurface 400 may be formed on an upper surface of the upper substrate 200, and may include a plurality of unit cells 410 made of metamaterials.

The metamaterial, which refers to an artificially designed material or an electromagnetic structure having a special electromagnetic characteristic that cannot be found in nature, may refer to a material or an electromagnetic structure of which both of permittivity and permeability are negative.

Such a material or structure is called a double negative (DNG) material due to having two negative parameters, and is also called a negative refractive index (NRI) material due to having a negative reflection coefficient according to the negative permittivity and permeability.

According to the above-described characteristics, an electromagnetic wave in the metamaterial is transferred by Fleming's left hand rule rather than Fleming's right hand rule. That is, a phase propagation direction (a phase velocity) and an energy transfer direction (a group velocity) of the electromagnetic wave are opposite, and thus a signal passing through the metamaterial has a negative phase delay. Thus, the metamaterial is referred to as a left-handed material (LHM).

In the metamaterial, a relationship between β (a phase constant) and w (a frequency) is non-linear, and a characteristic curve is even present on a left half surface of a coordinate plane. Due to the non-linear characteristic, a phase difference with respect to a frequency is small in the metamaterial, and a broadband circuit may be implemented. Since a phase change is not proportional to a length of a transmission line, a small-sized circuit may be implemented.

According to an embodiment of the present invention, each of the unit cells 410 may be configured as metal plates, and may be formed in a lattice structure in which the metal plates are arranged with gap of a predetermined size to have periodicity (P). In the drawings, a gap between adjacent metal plates is represented as g.

The broadband circularly polarized antenna using the metasurface according to the embodiment of the present invention is designed to have a center frequency of 5.5 GHz, and has a low profile, a broadband impedance matching, and a circular polarization characteristic.

Referring to FIGS. 1 to 3, it was confirmed that the antenna according to the present invention indicates an optimized characteristic when g is set to 0.5 mm, p is set to 8 mm, $h_1$ and $h_2$ are each set to 1.524 mm, $W_p$ is set to 13 mm, $W_f$ is set to 3 mm, $L_f$ is set to 4 mm, L, is set to 7 mm, and $F_y$ is set to 8.5 mm.

According to the embodiment of the present invention, the bandwidth of the antenna may be expanded by the structure of the radiator 300, of which the opposite corners are cut in the presence of the metasurface 400, as compared to a conventional circularly polarized patch antenna, and this may be confirmed through a comparison test with a patch antenna having another structure as follows.

Figure 4A:
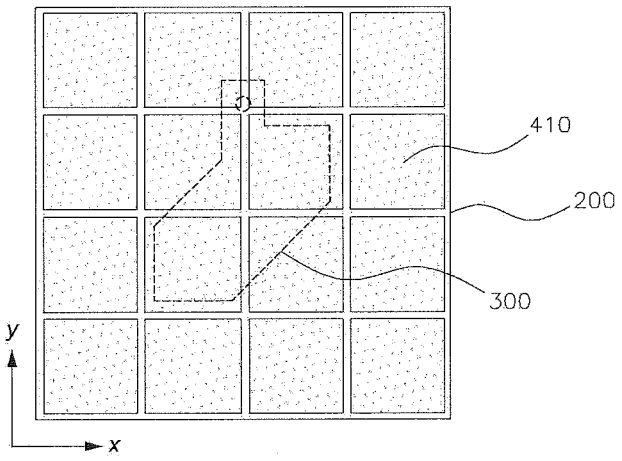
FIGS. 4A and 4B are, respectively, a plan view and a cross-sectional view illustrating an antenna according to an embodiment of the present invention.
Figure 4B:
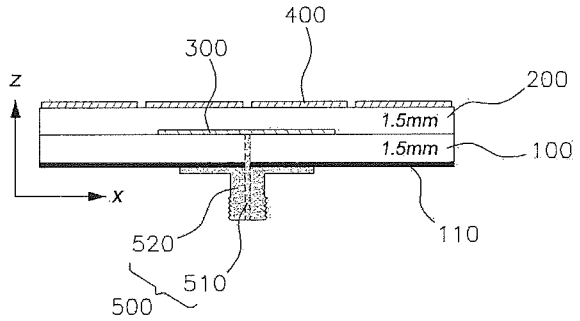
Figure 5A:
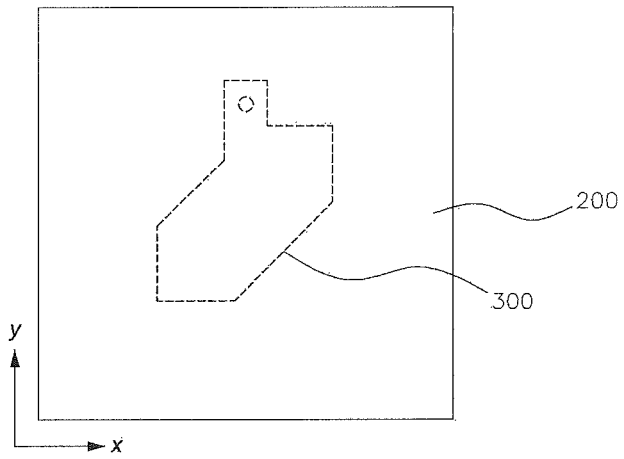
FIGS. 5A and 5B are, respectively, a plan view and a cross-sectional view illustrating an antenna according to Comparative example 1.
Figure 5B:
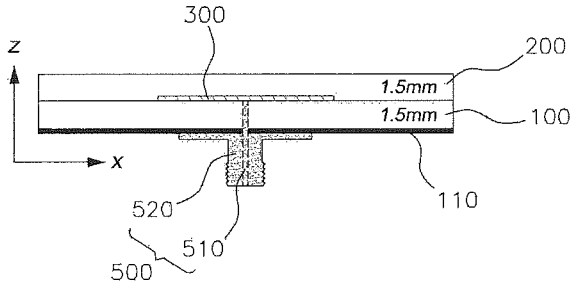
Figure 6A:
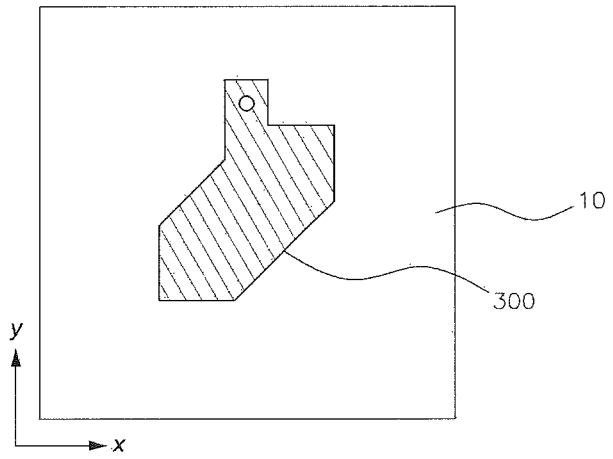
FIGS. 6A and 6B are, respectively, a plan view and a cross-sectional view illustrating an antenna according to Comparative example 2.
Figure 6B:
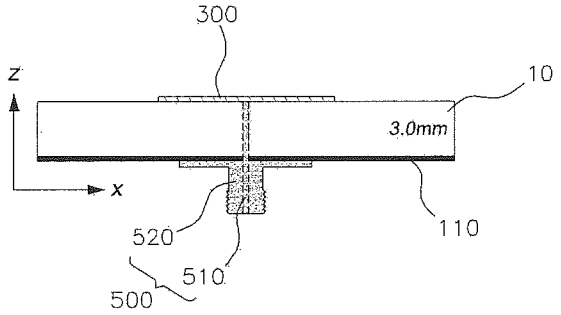
Figure 7A:
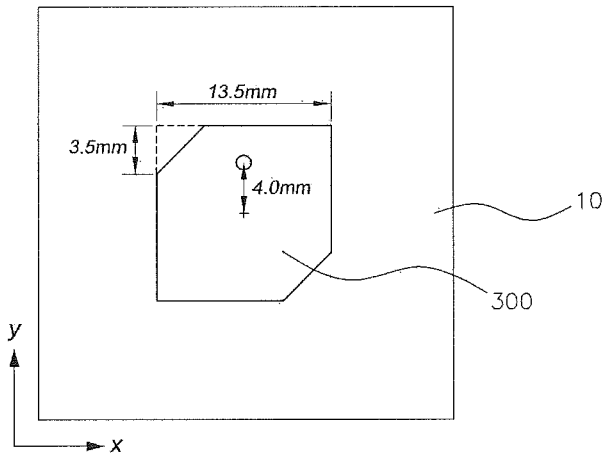
FIGS. 7A and 7B are, respectively, a plan view and a cross-sectional view illustrating an antenna according to Comparative example 3.
Figure 7B:
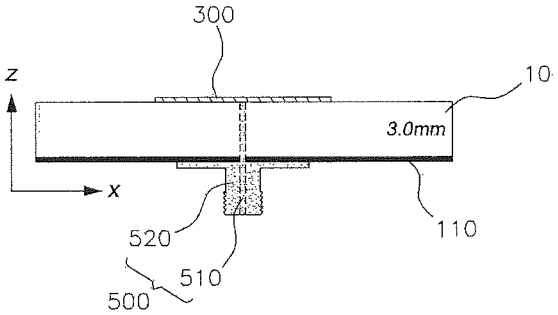

FIGS. 4A and 4B are, respectively, a plan view and a cross-sectional view illustrating an antenna according to an embodiment of the present invention, FIGS. 5A and 5B are, respectively, a plan view and a cross-sectional view illustrating an antenna according to Comparative example 1, FIGS. 6A and 6B are, respectively, a plan view and a cross-sectional view illustrating an antenna according to Comparative example 2, and FIGS. 7A and 7B are, respectively, a plan view and a cross-sectional view illustrating an antenna according to Comparative example 3.

Referring to FIGS. 4A and 4B, the antenna according to the embodiment of the present invention is the same as that described above.

Referring to FIGS. 5A and 5B, the antenna according to Comparative example 1 has a structure without a metasurface formed on the upper substrate 200 in the structure of the above embodiment.

Referring to FIGS. 6A and 6B, the antenna according to Comparative example 2 is formed with a single substrate 10 other than the upper substrate 200 and the lower substrate 100, and has a structure in which the same radiator 300 as in the above embodiment and Comparative example 1 is formed on an upper surface of the substrate 10.

Referring to FIGS. 7A and 7B, the antenna according to Comparative example 3 has the same structure as Comparative example 2 except for a shape of the radiator 300, is designed to have a center frequency (5.5 GHz) similar to the antenna according to the embodiment, and has a structure in which opposite corners of the radiator 300 are cut.

In order to accurately compare the antennas according to Comparative examples 1 to 3 and the embodiment, the antennas according to Comparative examples 1 to 3 are designed to have the same size as the antenna according to the embodiment, a substrate (Rogers R04003 sheet), a SubMiniature version A (SMA) connector, and the like.

Figure 8A:
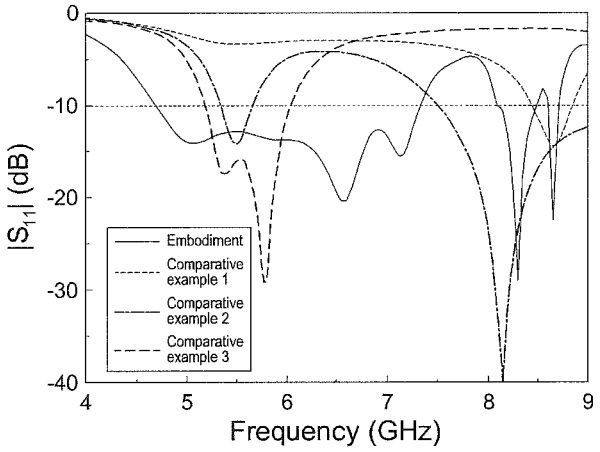
FIG. 8A is a graph illustrating simulation results for comparing reflection coefficient characteristics of the antennas according to the embodiment and Comparative examples 1 to 3.
Figure 8B:
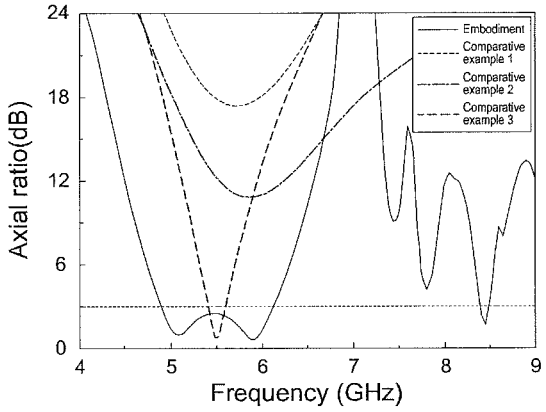
FIG. 8B is a graph illustrating simulation results for comparing axial ratio characteristics of the antennas according to the embodiment and Comparative examples 1 to 3.

FIG. 8A is a graph illustrating simulation results for comparing reflection coefficient characteristics of the antennas according to the embodiment and Comparative examples 1 to 3, and FIG. 8B is a graph illustrating simulation results for comparing axial ratio characteristics of the antennas according to the embodiment and Comparative examples 1 to 3.

In order to operate as an antenna, a reflection coefficient is preferably set to −10 dB or less. When the reflection coefficient is set to more than −10 dB, the performance of the antenna is generally reduced. In this case, when an axial ratio is set to 3 dB or less in a frequency band corresponding to the reflection coefficient of −10 dB or less, it may be seen that the antenna indicates a circular polarization characteristic.

Referring to FIGS. 8A and 8B, the antenna having a structure without a metasurface, that is, each of the antennas according to Comparative examples 1 to 3, has two resonances and a single minimum axial ratio point.

Specifically, in the antenna according to Comparative example 1, the resonances were generated at 5.5 GHz and 8.65 GHz, and the minimum axial ratio point was measured as 17.4 dB at 5.75 GHz.

In the antenna according to Comparative example 2, the resonances were generated at 5.5 GHz and 8.15 GHz, and the minimum axial ratio point was measured as 10.8 dB at 5.85 GHz.

It was confirmed that the antenna according to Comparative example 3 had a wide impedance matching band and indicated a circular polarization characteristic at 5.5 GHz.

Specifically, in the antenna according to Comparative example 3, the resonances were generated at 5.4 GHz and 5.8 GHz, the reflection coefficient bandwidth of −10 dB or less was measured as in the range of 5.20 to 6.05 GHz (15%), the minimum axial ratio point had 0.24 dB at 5.5 GHz, and an axial ratio bandwidth of 3 dB or less was measured as in the range of 5.4 to 5.6 GHz (3.6%).

In the antenna according to the embodiment of the present invention, resonances were generated at various frequencies, the reflection coefficient bandwidth of −10 dB or less was measured as in the range of 4.70 to 7.35 GHz (44%), the minimum axial ratio had 0.91 dB at 5.1 GHz, the minimum axial ratio had 0.53 dB at 5.9 GHz, and the axial ratio bandwidth of 3 dB or less was measured as in the range of 4.9 to 6.15 GHz (22.6%).

As described above, it may be confirmed that the impedance matching and the circular polarization characteristic were significantly improved in the antenna according to the embodiment of the present invention due to having the metasurface 400.

The metasurface 400 formed in the antenna according to the embodiment of the present invention has a reactive impedance substrate (RIS) structure, and, generally, the RIS structure is configured in a rectangular metal plate lattice formed on a dielectric substrate.

In the present invention, in order to decrease the height of the antenna, the antenna has a structure in which the radiator 300 of the antenna is sandwiched between the ground plane 110 and the metasurface 400.

A significant increase of the bandwidth of the circularly polarized antenna using the metasurface according to an embodiment of the present invention may be described as an effect of a surface wave propagated from an RIS-based antenna having a limited size.

That is, an additional resonance by the surface wave is generated at a specific frequency, and as a result, the performance of the antenna is improved.

In the RIS-based antenna, the analysis and modeling of surface wave resonance are known theoretically and computationally.

Figure 9A:
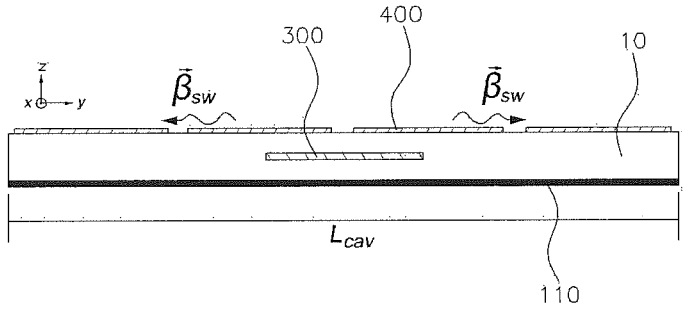
FIG. 9A is a conceptual diagram illustrating a propagation of a surface wave in an antenna using a metasurface.

FIG. 9A is a conceptual diagram illustrating propagation of a surface wave in an antenna using a metasurface In surface wave resonance, a total length of an RIS panel is the same as a resonance length of a surface wave moved along an RIS.

Therefore, the surface wave resonance may be determined by Equation 1 below by considering a metasurface having a limited sized, such as a cavity of FIG. 9A.

$$\beta_{sw} = \frac{\pi}{L_{cav}} \quad \text{[Equation 1]}$$

Here, $\beta_{sw}$ denotes a propagation constant of the above-described surface wave resonance, $L_{cav}$ denotes a total length of a metasurface structure, and $L_{cav}$ may be given by Equation 2 below.

$$L_{cav}=N*P \quad \text{[Equation 2]}$$

Here, N denotes the number of unit cells in a horizontal direction or a vertical direction, and P denotes periodicity of a metasurface.

Figure 9B:
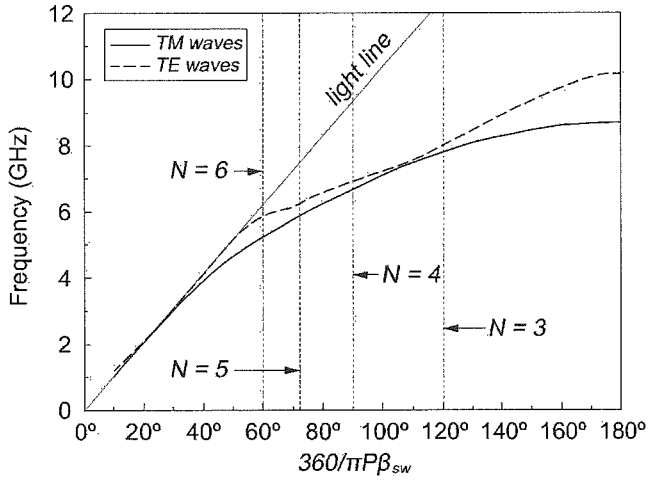
FIG. 9B is a dispersion diagram of resonating unit cells.

FIG. 9B is a dispersion diagram for unit cells resonating in the antenna of FIG. 9A.

Referring to FIG. 9B, a transverse magnetic (TM) wave mode and a transverse electric (TE) wave mode are illustrated, and the surface wave resonance may be obtained by an intersection point between a vertical line representing a right side value of Equation 1 and a dispersion curve.

In this case, the mode may refer to a form in which energy of a specific frequency in any structure is concentrated, and the mode of the resonance may refer to a resonance frequency and a resonance form. TE waves correspond to the case in which only an electric field is perpendicular to a propagation direction, and TM waves correspond to the case in which only a magnetic field is perpendicular to the propagation direction.

When N is set to 3, the resonance frequencies of the TM wave and the TE wave are respectively 7.48 GHz and 7.94 GHz, when N is set to 4, the resonance frequencies of the TM wave and the TE wave are respectively 6.67 GHz and 6.96 GHz, when N is set to 5, the resonance frequencies of the TM wave and the TE wave are respectively 5.8 GHz and 6.1 GHz, and when N is set to 6, the resonance frequencies of the TM wave and the TE wave are respectively 5.27 GHz and 5.88 GHz.

As can be seen in FIG. 8B, the rectangular patch antenna according to Comparative example 3 in which the opposite corners are cut has two resonances and a single lowest axial ratio point, and an additional resonance and lowest axial ratio points appear due to the presence of the surface wave resonance according to the present invention.

That is, as the surface wave propagated along the metasurface 400 is excited, the metasurface 400 additionally generates at least one of a resonance frequency in a reflection coefficient profile and a minimum axial ratio point in an axial ratio profile.

Figure 10:
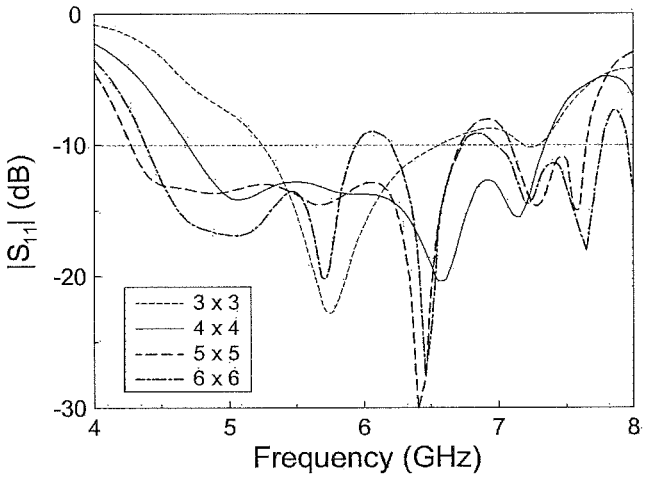
FIG. 10 is a graph for comparing simulation results of reflection coefficient characteristics which is changed according to the number of unit cells in a broadband circularly polarized antenna using a metasurface according to an embodiment of the present.

FIG. 10 is a graph for comparing simulation results of reflection coefficient characteristics which is changed according to the number of unit cells in a broadband circularly polarized antenna using a metasurface according to an embodiment of the present.

Specifically, antennas in which unit cells are formed to be arranged in forms of 3×3, 4×4, 5×5, and 6×6 are compared.

Referring to FIG. 10, it may be confirmed that all structures of the circularly polarized patch antenna using the metasurface indicate resonance frequencies greater than two. Through this, as a surface wave propagated from the metasurface is excited, it may be seen that additional resonances are generated at an antenna system.

Two resonances in a low-frequency region are generated by the radiator 300, whereas additional resonances in a high-frequency region are generated by the surface wave.

Therefore, the resonances generated by the TM surface wave and the TE surface wave may be respectively defined as third and fourth resonance frequencies of the antenna according to the embodiment of the present invention.

The resonance frequencies may be determined through a reflection coefficient profile, and may be determined by observing the frequencies at an imaginary part of an input impedance Z11 which is close to zero.

As results of various simulations of the antenna according to the embodiment of the present invention according to the number of the unit cells, in the case of the unit cells of 3×3, resonances of the TM wave and the TE wave were measured respectively at 7.2 GHz and 7.8 GHz, in the case of the unit cells of 4×4, resonances of the TM wave and the TE wave were measured respectively at 6.15 GHz and 6.6 GHz, in the case of the unit cells of 5×5, resonances of the TM wave and the TE wave were measured respectively at 5.4 GHz and 5.7 GHz, and in the case of the unit cells of 6×6, resonances of the TM wave and the TE wave were measured respectively at 5.1 GHz and 5.65 GHz.

When compared to the results in FIG. 9B, because the radiator 300 is strongly coupled to the metasurface, it may be seen that a slight frequency transition occurred.

As can be seen from these results, the additional resonances generated in the reflection coefficient profile may be determined by the number of the unit cells, and thus it may be seen that the performance of the antenna can be improved.

Figure 11:
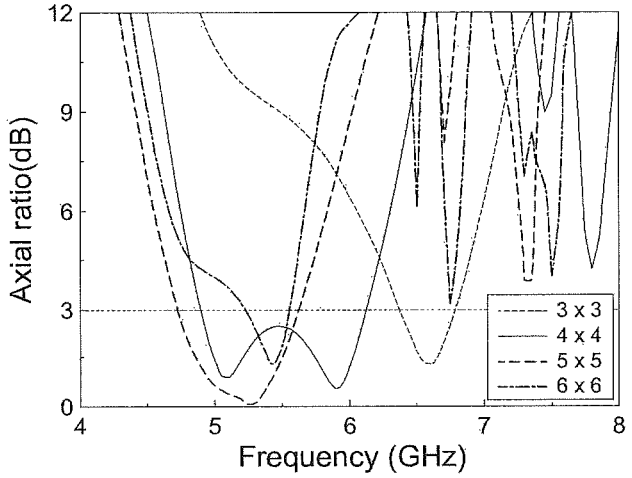
FIG. 11 is a graph for comparing simulation results of axial ratio characteristics which is changed according to the number of unit cells in a broadband circularly polarized antenna using a metasurface according to an embodiment of the present.

FIG. 11 is a graph for comparing simulation results of axial ratio characteristics which is changed according to the number of unit cells in a broadband circularly polarized antenna using a metasurface according to an embodiment of the present.

As can be seen in FIG. 8B, the radiator 300 itself generates only a single lowest axial ratio point. In contrast, referring to FIG. 11, it may be seen that all structures of the circularly polarized patch antenna using the metasurface represent various lowest axial ratio points.

Thus, it may be seen that a surface wave propagated from the metasurface generates additional circularly polarized radiation. Similarly to the reflection coefficient profile, the lowest axial ratio point which indicates the lowest frequency is generated by a driven patch, and the higher frequencies are generated by the surface wave.

As the number of the unit cells is increased, the lowest axial ratio point generated by the driven patch is slightly changed. It may be seen that the minimum axial ratio point generated by the surface wave is moved to a low-frequency region.

Through the above results, it may be seen that a band range indicating the circular polarization characteristic may be obtained, and referring to FIG. 11, the best result may be obtained when considering the axial ratio bandwidth of 3 dB or less when the unit cells are arranged in 4×4 in the lattice structure.

Figure 12:
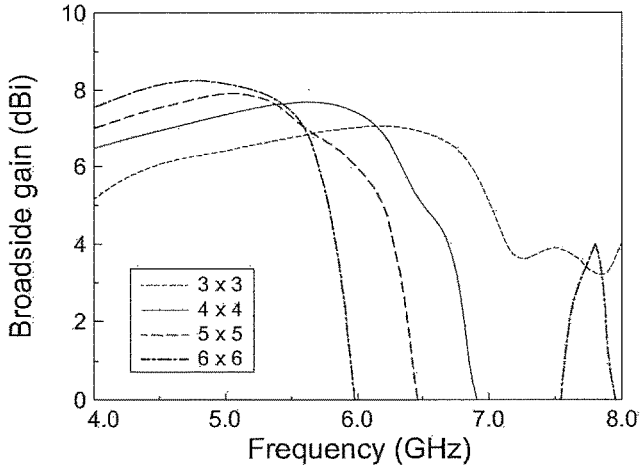
FIG. 12 is a graph for comparing simulation results of broadside gain characteristics which is changed according to the number of unit cells in a broadband circularly polarized antenna using a metasurface according to an embodiment of the present.
Figure 13A:
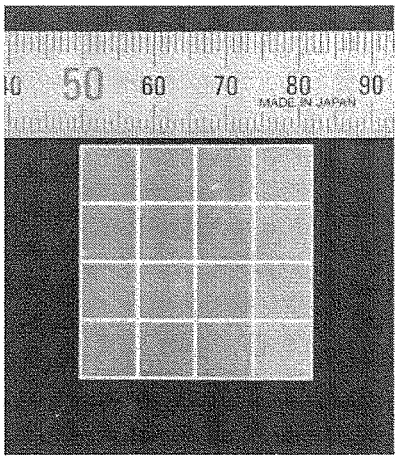
FIGS. 13A to 13D are photographs respectively illustrating a plan view, a radiator, a rear view, and a cross-sectional view of an antenna manufactured according to an embodiment of the present invention.
Figure 13B:
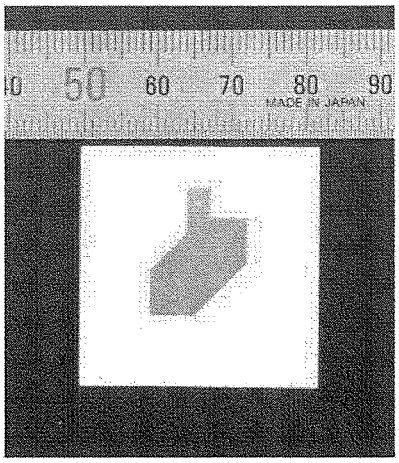
Figure 13C:
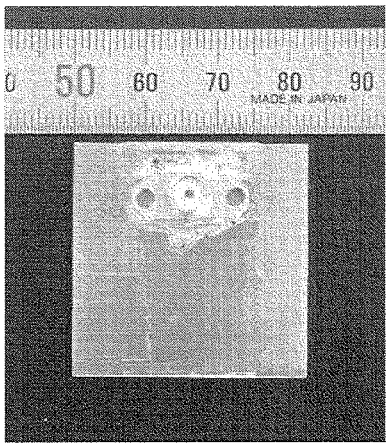
Figure 13D:
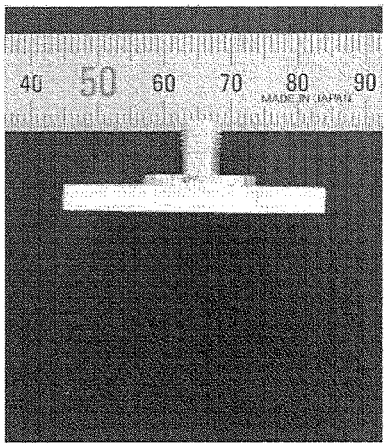

FIG. 12 is a graph for comparing simulation results of broadside gain characteristics which is changed according to the number of unit cells in a broadband circularly polarized antenna using a metasurface according to an embodiment of the present.

Referring to FIG. 12, it may be confirmed that all structures of the circularly polarized patch antenna using the metasurface indicate an excellent gain characteristic in a low-frequency region. However, since gain is significantly reduced in a high-frequency region, it is necessary to consider this characteristic when applied to the antenna.

FIGS. 13A to 13D are photographs respectively representing a plan view, a radiator, a rear view, and a cross-sectional view illustrating an antenna manufactured according to an embodiment of the present invention.

Specifically, the radiator and the metasurface were manufactured using a Rogers R04003 sheet, and a total size thereof was 32×32×3.048 $mm^3$—

In order to measure the reflection coefficient of the antenna, an Agilent N5230A network analyzer and a 3.5-mm coaxial calibration standards-GCS35M were used.

In order to measure the radiation patterns of the antenna, an anechoic chamber having a size of 15.2 m (W)×7.9 m (L)×7.9 m (H) was used.

In order to measure the radiation patterns, a standard broadband circular polarization horn antenna was used for transmission, the antenna according to the present invention was used for reception, and a distance between the two antennas was set to 10 m.

The horn antenna was fixed, and the antenna according to the present invention was rotated from −180 degrees to 180 degrees with a detection angle of 1 degree and a velocity of 3 degrees per second. An axial ratio value was measured at a θ of 0 degree and a ϕ of 0 degree. Radiation efficiency was measured using an apparatus for measuring three-dimensional (3D) radiation patterns.

Figure 14A:
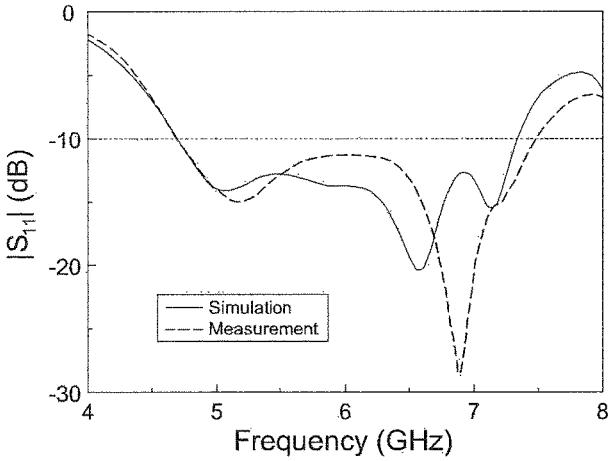
FIG. 14A is a graph for comparing a simulation result and a measurement result of a reflection coefficient of a broadband circularly polarized antenna using a metasurface according to an embodiment of the present invention.

FIG. 14A is a graph for comparing a simulation result and a measurement result of a reflection coefficient of a broadband circularly polarized antenna using a metasurface according to an embodiment of the present invention.

As illustrated above, the measured reflection coefficient bandwidth of −10 dB or less was indicated in the range of 4.70 to 7.48 GHz (45.6%), the simulated reflection coefficient bandwidth of −10 dB or less was indicated in the range of 4.70 to 7.35 GHz (44%), and thus it may be seen that the measurement result and the simulation result were significantly consistent.

Figure 14B:
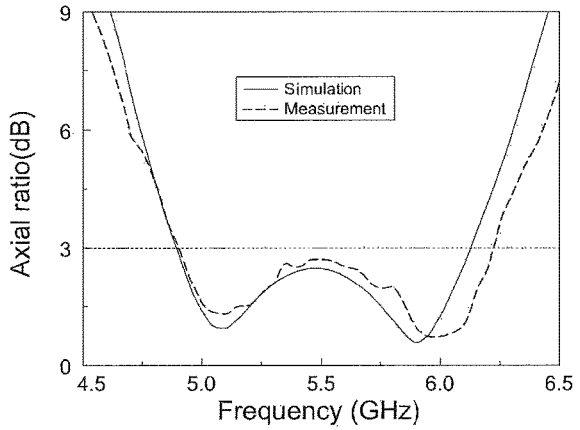
FIG. 14B is a graph for comparing a simulation result and a measurement result of an axial ratio of a broadband circularly polarized antenna using a metasurface according to an embodiment of the present invention.

FIG. 14B is a graph for comparing a simulation result and a measurement result of an axial ratio of the broadband circularly polarized antenna using the metasurface according to the embodiment of the present invention.

As illustrated above, the measured axial ratio bandwidth of 3 dB or less was indicated in a range of 4.90 to 6.20 GHz (23.4%), the simulated axial ratio bandwidth of 3 dB or less was indicated in the range of 4.9 to 6.1 GHz (22%), and thus it also may be seen that the measurement result and the simulation result were significantly consistent.

As the measurement result, two lowest axial ratio points were generated and were measured as 1.26 dB at 5.10 GHz and as 0.70 dB at 5.95 GHz, respectively.

Figure 15A:
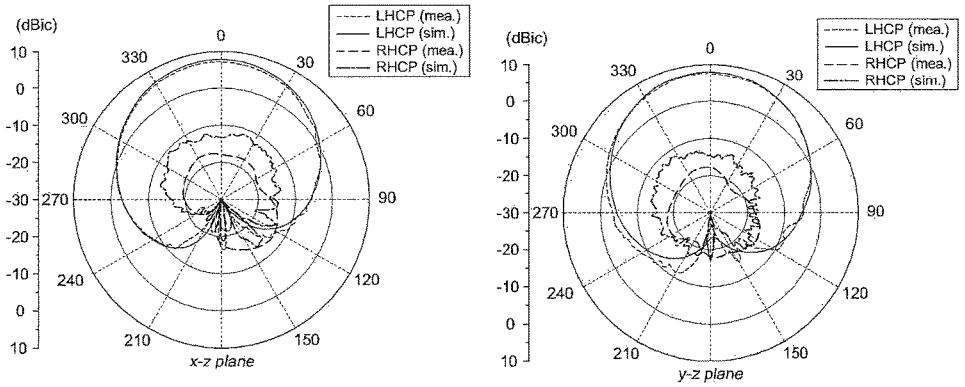
FIG. 15A is a view illustrating radiation patterns of a broadband circularly polarized antenna using a metasurface according to an embodiment of the present invention, which were simulated and measured at 5.1 GHz.
Figure 15B:
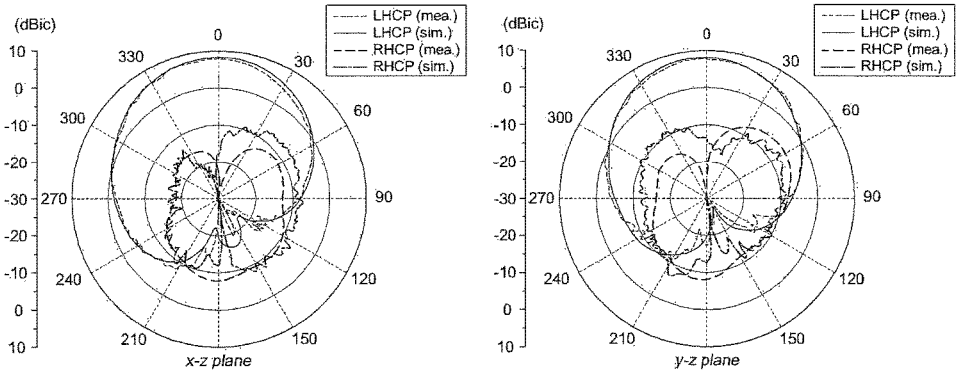
FIG. 15B is a view illustrating radiation patterns of a broadband circularly polarized antenna using a metasurface according to an embodiment of the present invention, which were simulated and measured at 5.9 GHz.

FIG. 15A is a view illustrating radiation patterns of a broadband circularly polarized antenna using a metasurface according to an embodiment of the present invention, which were simulated and measured at 5.1 GHz, and FIG. 15B is a view illustrating radiation patterns of the broadband circularly polarized antenna using the metasurface according to the embodiment of the present invention, which were simulated and measured at 5.9 GHz.

Referring to FIGS. 15A and 15B, it may be seen that the measurement result and the simulation result were significantly consistent, and the radiation patterns were left-hand circularly polarized and both of an x-z plane and a y-z plane were slightly symmetrical.

In the circularly polarized antenna at 5.1 GHz, a measured gain was 7.03 dBic, a measured front back ratio was 25.4 dB, and a measured half power beam width was 82 degrees in the x-z plane and 85 degrees in the y-z plane.

In the circularly polarized antenna at 5.90 GHz, a measured gain was 7.4 dBic, a measured front back ratio was 20.1 dB, and a measured half power beam width was 68 degrees in the x-z plane and 71 degrees in the y-z plane.

Figure 16:
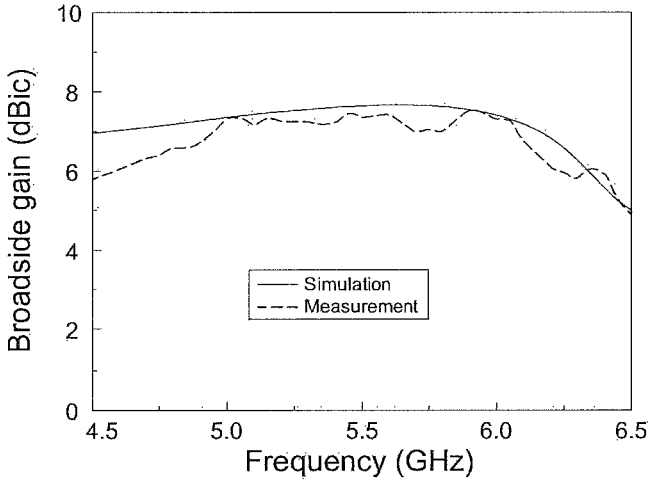
FIG. 16 is a graph for comparing a simulation result and a measurement result of a broadside gain of a broadband circularly polarized antenna using a metasurface according to an embodiment of the present invention.

FIG. 16 is a graph for comparing a simulation result and a measurement result of a broadside gain of a broadband circularly polarized antenna using a metasurface according to an embodiment of the present invention.

All of the measurement and simulation results of the antenna manufactured according to the embodiment of the present invention indicate a small change of gain at a level of ±0.3 dBic.

Within a circularly polarized radiation bandwidth, the measured broadside gain was in the range of 7.0 to 7.6 dBic, and the simulated broadside gain was in the range of 7.2 to 7.7 dBic.

When comparing to the measurement result and the simulation result, it was shown that antenna efficiency of the measurement result was greater than 90%, and antenna efficiency of the simulation result was greater than 94% within the axial ratio bandwidth of 3 dB.

TABLE 1

| Items | Size ($\lambda_o^3$) | Reflection coefficient bandwidth of -10 dB or less | Axial ratio bandwidth of 3 dB or less | Gain (dBic) |
|---|---|---|---|---|
| Embodiment | 0.58 × 0.58 × 0.056 | 45.6% | 23.4% | 7.6 |
| Comparative example 4 | 0.62 × 0.62 × 0.150 | 42.3% | 16.8% | 6.7 |
| Comparative example 5 | 0.80 × 0.80 × 0.090 | 31.5% | 20.7% | 8.6 |
| Comparative example 6 | 0.77 × 0.77 × 0.060 | 11.4% | 14.9% | 5.7 |
| Comparative example 7 | 0.78 × 0.80 × 0.096 | 48.6% | 20.4% | 6.5 |
| Comparative example 8 | 1.00 × 1.00 × 0.068 | 25.7% | 8.0% | 8.0 |

Table 1 is a table comparing characteristics of the antenna according to the embodiment of the present invention and conventional antennas. Here, $\lambda_o$ may refer to a free space wavelength of an antenna center frequency.

(Comparison example 4: Q. Lin, H. Wong, X. Zhang, and H. Lai, "Printed meandering probe-fed circularly polarized patch antenna with wide bandwidth," IEEE Antennas Wireless Propag. Lett., vol. 13, pp. 654-657, 2014.

Comparison example 5: W. Yang, J. Zhou, Z. Yu, and L. Li, "Single-fed low profile broadband circularly polarized stacked patch antenna," IEEE Trans. Antennas Propag., vol. 62, no. 10, pp. 5406-5410, October 2014.

Comparison example 6: L. Bernard, G. Chetier, and R. Sauleau, "Wideband circularly polarized patch antennas on reactive impedance substrates," IEEE Antennas Wireless Propag. Lett., vol. 10, pp. 1015-1018, 2011.

Comparison example 7: R. Nakamura and T. Fukusako, "Broadband design of circularly polarized microstrip patch antenna using artificial ground structure with rectangular unit cells," IEEE Trans. Antennas Propag., vol. 59, no. 6, pp. 2103-2110, June 2011.

Comparison example 8: H. Zhu, S. Cheung, K. Chung, and T. Yuk, "Linear-to-circular polarization conversion using metasurface," IEEE Trans. Antennas Propag., vol. 61, no. 9, pp. 4615-4623, September 2013.)

As can be seen in Table 1, it may be confirmed that the antenna using the metasurface according to the embodiment of the present invention indicates a wide axial ratio bandwidth of 3 dB or less, a low profile, and a small volume characteristic compared to the conventional antennas.

Further, as described above, in the circularly polarized antenna according to the present invention, broadband impedance matching and a circular polarization characteristic may be implemented through the resonance generated by the radiator, the additional resonance generated by the minimum axial ratio point and the metasurface, and the minimum axial ratio point.

As the antenna according to the present invention uses a structure in which a radiator is sandwiched between a metasurface and a ground plane, a broadband impedance matching and a circular polarization characteristic can be simultaneously implemented through a resonance generated by the radiator, an additional resonance generated by a minimum axial ratio point and the metasurface, and a minimum axial ratio point.

As described above, an optimal embodiment is disclosed in drawings and specifications. Here, the specific terms used herein are for the purpose of describing particular embodiments only and are not intended to be limiting of the meaning or the scope of the invention described in the claims. It should be understood by those skilled in the art that various changes in forms and equivalent other embodiment may be made. Therefore, the scope of the invention is defined by the appended claims.

What is claimed is:

1. A broadband circularly polarized antenna using a metasurface, the antenna comprising:

a lower substrate;

an upper substrate stacked on the lower substrate;

a radiator located between the lower substrate and the upper substrate, having a rectangular patch shape in which two triangular removed parts are formed by removing opposite corners in a triangular shape, and including an extended strip configured to extend so as to have a predetermined width and length from one end of a hypotenuse of one triangular removed part of the triangular removed parts and having a feed hole formed therein; and the metasurface formed on an upper surface of the upper substrate and including a plurality of unit cells.

2. The antenna of claim 1, wherein the extended strip is formed to protrude from one side of the radiator in a vertical direction.

3. The antenna of claim 1, wherein the two triangular removed parts are symmetrical with respect to a center of the radiator.

4. The antenna of claim 1, further comprising a feed connected to the feed hole of the radiator and configured to transfer a signal.

5. The antenna of claim 4, wherein a ground plane is formed on a lower surface of the lower substrate.

6. The antenna of claim 5, wherein an inner part of the feed is electrically connected to the feed hole of the radiator by passing through the lower substrate, and an outer part of the feed is electrically connected to the ground plane.

7. The antenna of claim 1, wherein the unit cells are each configured as metal plates, and are formed in a lattice structure in which the metal plates are arranged with a gap of a predetermined size to have periodicity.

8. The antenna of claim 7, wherein a surface wave propagated along the metasurface is excited, and the metasurface additionally generates at least one of a resonance frequency in a reflection coefficient profile and a minimum axial ratio point in an axial ratio profile.

9. The antenna of claim 8, wherein the lattice structure is formed so that the unit cells are arranged in a 4×4 therein.

10. The antenna of claim 8, wherein the minimum axial ratio point generated by the surface wave tends to move to a low-frequency region as a number of the unit cells is increased.

11. The antenna of claim 1, wherein the radiator is formed on an upper surface of the lower substrate.

* * * * *